US010589144B2

(12) United States Patent
Specht et al.

(10) Patent No.: US 10,589,144 B2
(45) Date of Patent: Mar. 17, 2020

(54) ADJUSTABLE BENCH ASSEMBLY

(71) Applicant: Rep Fitness, LLC, Boulder, CO (US)

(72) Inventors: Christopher James Specht, Denver, CO (US); Ryan James McGrotty, Broomfield, CO (US)

(73) Assignee: Rep Fitness, LLC, Boulder, CO (US)

( * ) Notice: Subject to any disclaimer, the term of this patent is extended or adjusted under 35 U.S.C. 154(b) by 0 days.

(21) Appl. No.: 15/289,747

(22) Filed: Oct. 10, 2016

(65) Prior Publication Data

US 2018/0099176 A1 Apr. 12, 2018

(51) Int. Cl.
*A63B 21/00* (2006.01)
*A63B 69/00* (2006.01)

(52) U.S. Cl.
CPC .. *A63B 21/4029* (2015.10); *A63B 2069/0062* (2013.01); *A63B 2225/09* (2013.01)

(58) Field of Classification Search
CPC ... A63B 21/4029–4031; A63B 22/0087–0089; A47C 1/02; A47C 1/022–028
See application file for complete search history.

(56) References Cited

U.S. PATENT DOCUMENTS

| | | | | |
|---|---|---|---|---|
| 4,207,879 | A | 6/1980 | Safadago et al. | |
| 4,468,025 | A | 8/1984 | Sferle | |
| 4,621,809 | A | 11/1986 | Pearl | |
| 4,911,501 | A * | 3/1990 | Decker | A47C 1/03255 297/285 |
| 5,370,595 | A | 12/1994 | Voris et al. | |
| 5,803,884 | A | 9/1998 | Sharp | |
| 6,287,243 | B1 | 9/2001 | Isom et al. | |
| 6,371,896 | B1 | 4/2002 | Kettler | |
| 6,605,023 | B1 | 8/2003 | Mobley | |
| 6,666,802 | B1 | 12/2003 | Rasmussen | |
| 6,939,272 | B1 | 9/2005 | Wu | |
| 6,966,872 | B2 | 11/2005 | Eschenbach | |
| 7,153,249 | B2 | 12/2006 | O'Connor | |
| 7,604,580 | B2 | 10/2009 | Lamarque | |
| 9,022,911 | B2 | 5/2015 | Goldberg | |
| 9,168,416 | B2 | 10/2015 | Ho | |
| 2003/0050157 | A1 * | 3/2003 | Teuscher | A63B 21/00 482/142 |
| 2013/0113254 | A1 * | 5/2013 | Augustat | A47C 3/20 297/313 |
| 2018/0206647 | A1 * | 7/2018 | Kieryllo | A47C 9/005 |

FOREIGN PATENT DOCUMENTS

| | | | |
|---|---|---|---|
| EP | 0208208 | A1 | 1/1987 |
| GB | 2195090 | A | 3/1988 |

OTHER PUBLICATIONS

BENQ Medical Technology Corp., TriMax 650NS Series brochure, http://www.xcelsitas.com/index.php/selected2/trimax-650ns-series.html, 6pgs (2015).

* cited by examiner

*Primary Examiner* — Jennifer Robertson

(57) ABSTRACT

An adjustable bench has a frame with a seat support pivotably coupled to the frame. The seat support includes a slide assembly which allows the seat to be slidably positioned relative to the frame. A back support is also pivotably coupled to the frame.

18 Claims, 15 Drawing Sheets

ADJUSTABLE BENCH ASSEMBLY

BACKGROUND

Some exercises are performed while lying down on a bench or seated. These exercises can be performed while holding or using supplemental exercise equipment, such as weights, resistance bands, exercise balls, etc. Benches or seats used when performing these exercises may be in a public facility, such as a gym, or a private facility, such as in home.

SUMMARY

Techniques and apparatus disclosed herein relate to adjustable support benches. Adjustable support benches disclosed herein can be used during exercise, although other uses are contemplated.

In one aspect, the technology relates to an adjustable bench including: a frame; a seat support pivotably coupled to the frame, wherein the seat support further includes a slide assembly configured to be slidably positioned relative to the frame; and a back support pivotably coupled to the frame. In an example, the adjustable bench further includes a pivot arrangement connecting the frame to both the seat support and the back support. In another example, the adjustable bench further includes a first pad connected to the slide assembly. In yet another example, the adjustable bench further includes a second pad connected to the back support. In still another example, the adjustable bench further includes a first arcuate assembly in communication with the frame and the seat support, the first arcuate assembly including a first arcuate member and a first detent.

In another example, the adjustable bench further includes a second arcuate assembly in communication with the frame and the back support, the second arcuate assembly including a second arcuate member and a second detent. In an example, the first arcuate assembly includes a seat range of motion of at least 15 degrees and no greater than 120 degrees. In another example, the second arcuate assembly includes a back range of motion of at least 15 degrees and no greater than 95 degrees. In yet another example, the back support further includes a leg support arrangement. In still another example, the leg support arrangement is slidably coupled to the back support.

In another example of the above aspect, the leg support arrangement further includes a grip member. In an example, the frame further includes: a lift bar positioned near a first end of the frame; and a roller assembly positioned near a second end of the frame.

In another aspect, the technology relates to an exercise support assembly having: a frame arrangement; a lower support pivotably connected to the frame arrangement at a pivot arrangement, the lower support including a slide assembly providing slidable adjustment of the lower support, the lower support including a first pad; and an upper support pivotably connected to the frame arrangement at the pivot arrangement and independently pivotable from the lower support, the upper support including a second pad. In an example, the exercise support assembly further includes: a first arcuate assembly in communication with the frame arrangement and the lower support, the first arcuate assembly including a first arcuate member and a first detent; and a second arcuate assembly in communication with the frame arrangement and the upper support, the second arcuate assembly including a second arcuate member and a second detent, wherein each of the slide assembly, the first arcuate assembly and the second arcuate assembly are independently adjustable. In another example, the first arcuate assembly provides a lower support pivot range of at least 15 degrees and no greater than 120 degrees; and the second arcuate assembly provides an upper support pivot range of at least 15 degrees and no greater than 95 degrees. In yet another example, the first arcuate member defines at least three position apertures, each of the at least three position apertures sized to receive the first detent; and wherein the second arcuate member defines at least five position apertures, each of the at least five position apertures sized to receive the second detent. In still another example, the upper support further includes a leg arrangement, the leg arrangement slidably coupled to the upper support.

In another example of the above aspect, the leg arrangement further includes a grip member and a third detent. In an example, the frame arrangement further includes: a lift bar positioned near a first end of the frame arrangement; and a roller assembly positioned near a second end of the frame arrangement.

In another aspect, the technology relates to a method of using an adjustable bench assembly, including: adjusting a seat support using a slide assembly coupled to the adjustable bench assembly; independent of adjusting the seat support using the slide assembly, adjusting the seat support using a seat pivot adjuster coupled to the adjustable bench assembly and the seat support; and independent of adjusting the seat support using the slide assembly and independent of adjusting the seat support using the seat pivot adjuster, adjusting a back support using a back pivot adjuster coupled to the adjustable bench assembly and the back support.

The details of one or more examples are set forth in the accompanying drawings and the description below. Other features, objects, and advantages of these examples will be apparent from the description, drawings, and claims. Moreover, it is to be understood that both the foregoing summary of the disclosure and the following detailed description are exemplary and intended to provide further explanation without limiting the scope of the disclosure.

BRIEF DESCRIPTION OF THE DRAWINGS

The following figures, which form a part of this application, are illustrative of described technology and are not meant to limit the scope of the claims in any manner.

DETAILED DESCRIPTION

Figure 1:
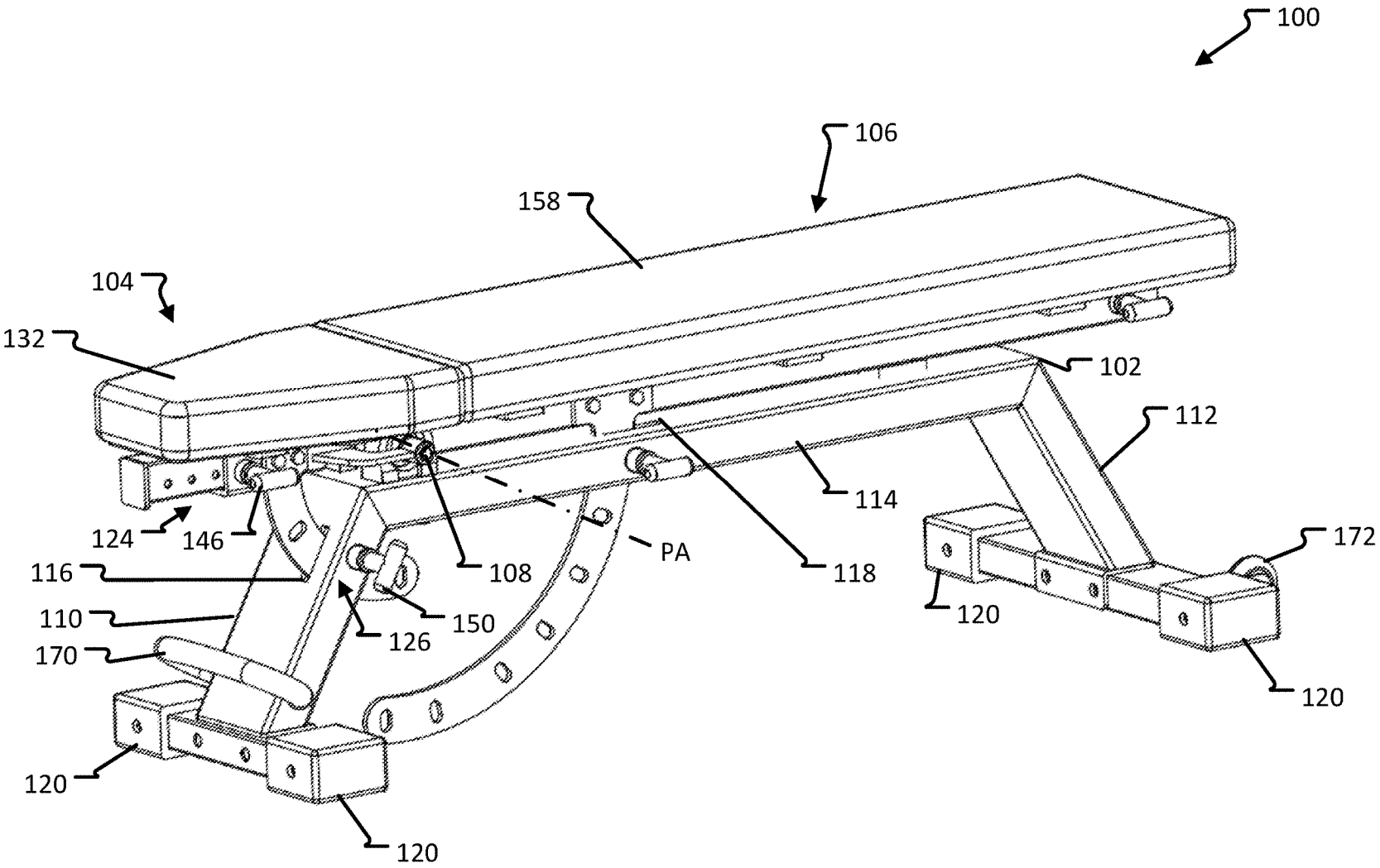
FIG. 1 is a front perspective view of an example adjustable bench assembly.
Figure 2:
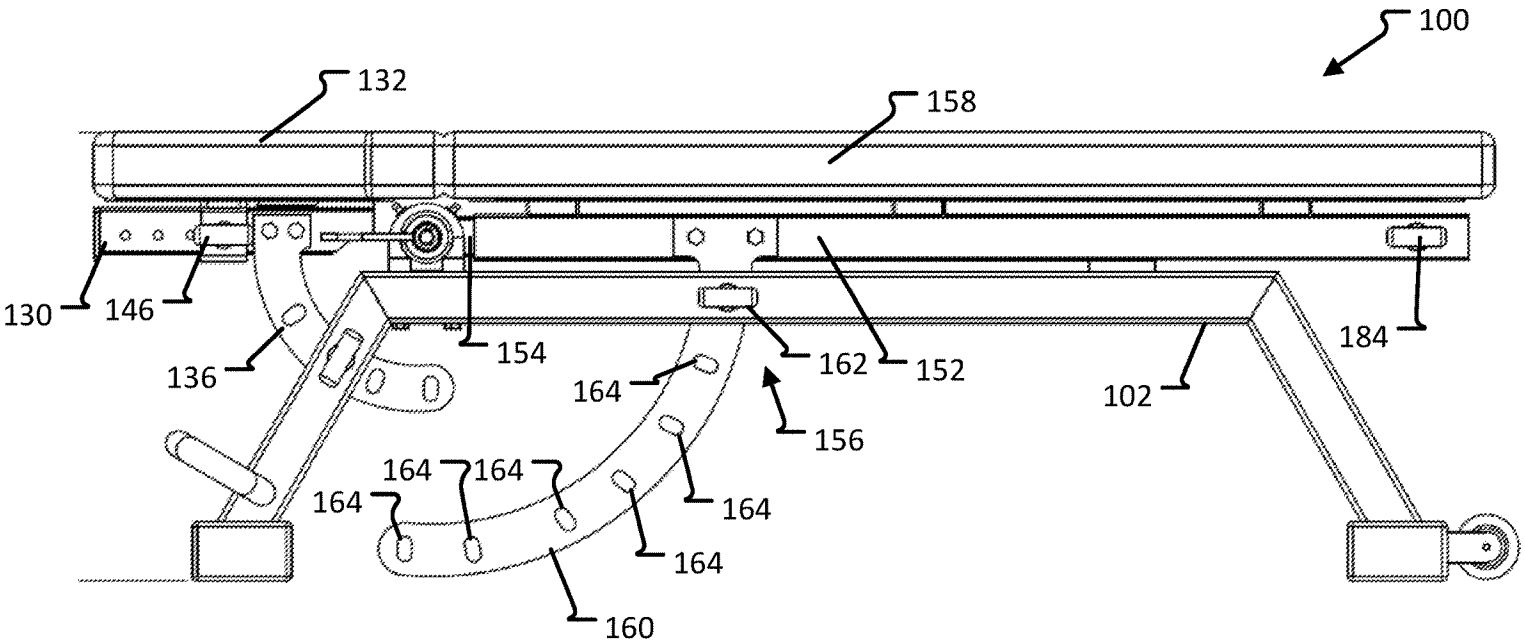
FIG. 2 is a right side plan view of the adjustable bench assembly of FIG. 1.
Figure 3:
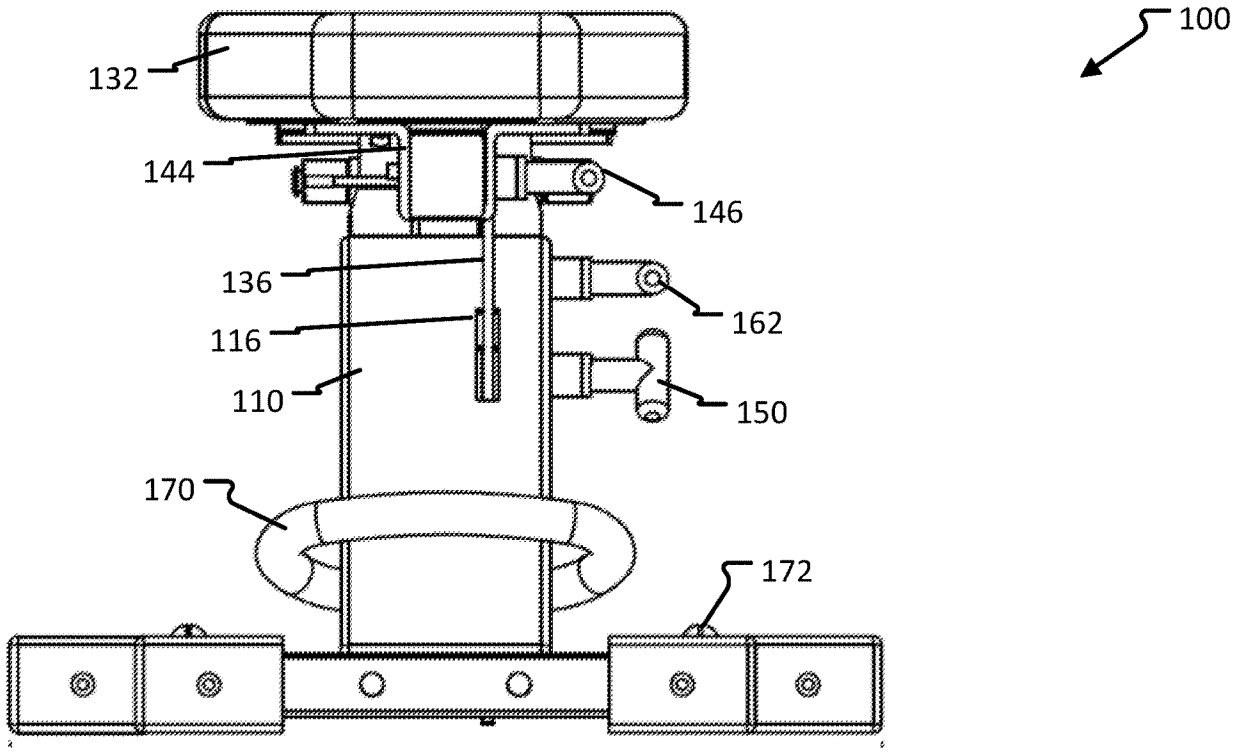
FIG. 3 is a front plan view of the adjustable bench assembly of FIG. 1.
Figure 4:
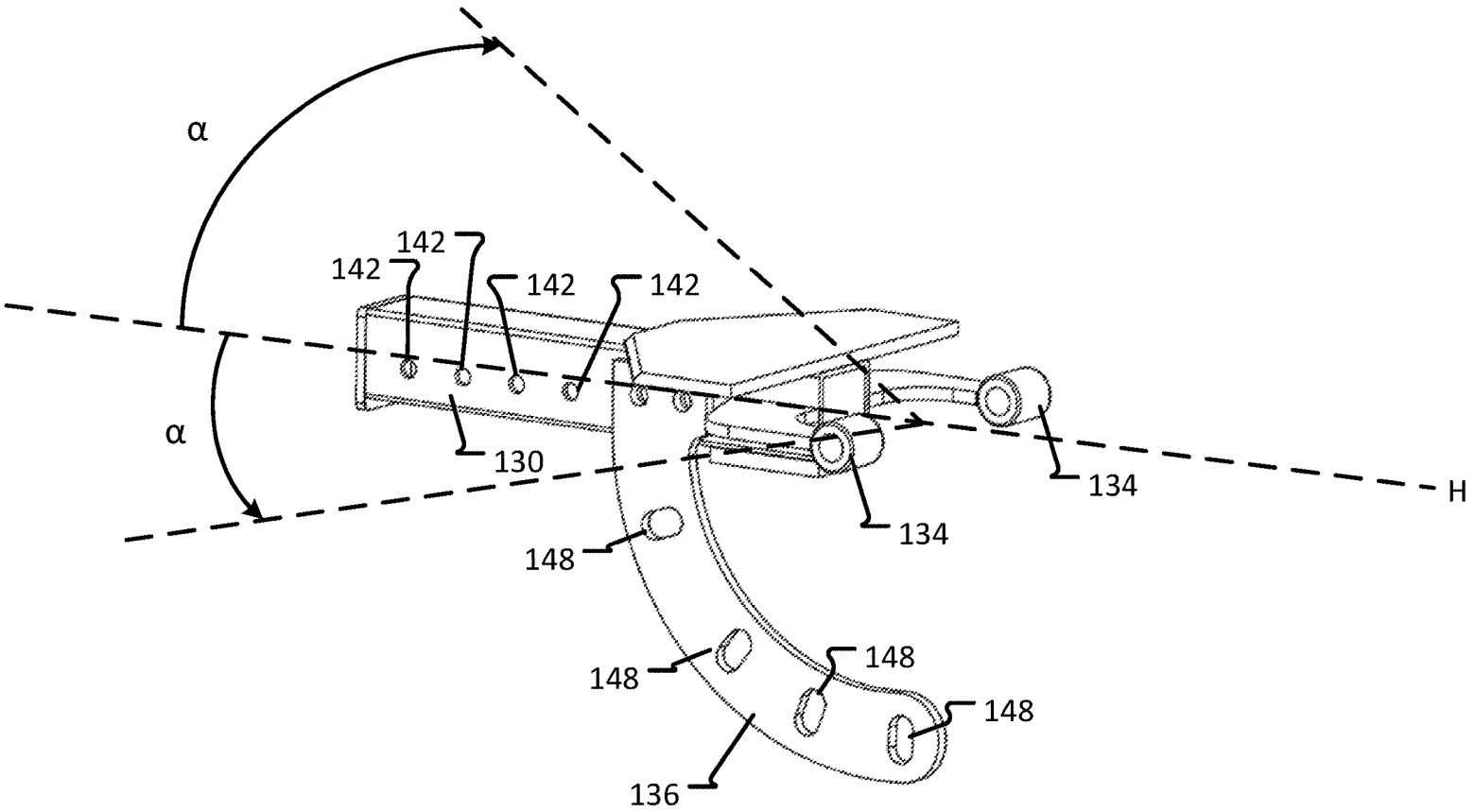
FIGS. 4 and 5 are perspective views of components of a seat support of the adjustable bench assembly of FIG. 1.
Figure 5:
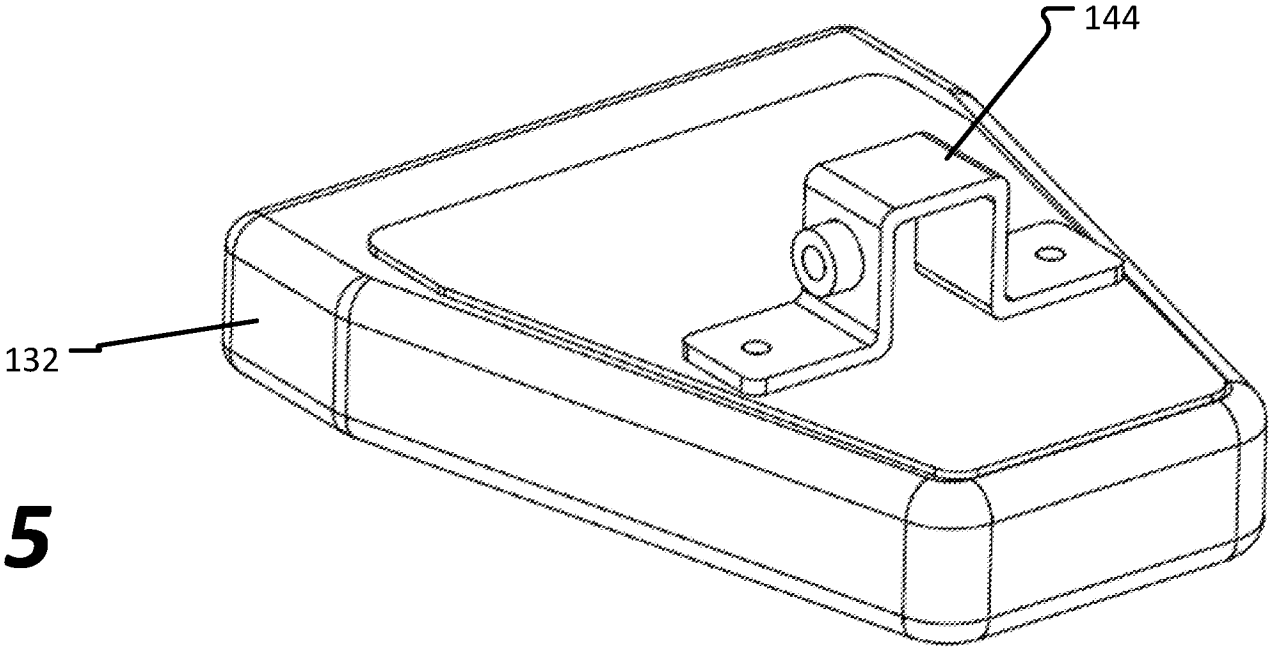

Various examples of the present invention will be described in detail with reference to the drawings, wherein like reference numerals represent like parts and assemblies throughout the several views. The features described herein are examples of implementations of certain broad, inventive aspects which underlie the disclosure.

As briefly described above, examples of the present invention are directed to providing an adjustable bench assembly. Adjustable bench assemblies contemplated by this disclosure can be used for various activities, such as exercise activities. The adjustable bench assemblies disclosed herein can be utilized as a step, a seat, and/or a support for a prone position. In some instances, the person using the adjustable bench assembly can be oriented generally parallel to, or angled towards, a floor upon which the adjustable bench assembly rests. The pivoting and sliding supports described below allow an adjustable bench assembly to be used comfortably by a variety of users, and can be adjusted to provide individual support and comfort, based on a user's particular preferences or needs.

FIGS. 1-6 depict various views of an example adjustable bench assembly 100 and are described concurrently below. The adjustable bench assembly 100 includes frame 102, seat support 104, and back support 106. Both seat support 104 and back support 106 are connected to frame 102 via pivot arrangement 108. Typically, adjustable bench assembly 100 is used during exercise or to facilitate an exercise. Other examples can include more or fewer components.

Frame 102 provides stability to adjustable bench assembly 100. Frame 102 also provides structure to which seat support 104 and back support 106 are connected. Generally, frame 102 includes a middle portion 114 connected to two leg portions 110 and 112. For example, leg portions 110 and 112 can be connected to middle portion 114 via welding, bolt members, adhesive, or the like.

Frame 102 also defines seat aperture 116 and back aperture 118. Preferably, seat aperture 116 is near a front end of frame 102, e.g. in leg portion 110. Back aperture 118 is near a middle of middle portion 114. Seat support 104 allows for independent lateral and pivotal adjustability of seat pad 132 relative to frame 102.

Broadly, seat support 104 includes slide assembly 124 and seat arcuate assembly 126. Slide assembly 124 includes seat support frame 130 defining position apertures 142, mounting bracket 144, and slide detent (or pin) 146. Mounting bracket 144 slidably connects to seat support frame 130 and may be moved between a plurality of positions therealong by engagement and disengagement of slide detent 146 with the plurality of position apertures 142. Seat pad 132 is connected to the mounting bracket 144 so as to move laterally therewith.

Seat arcuate assembly 126 includes seat arcuate member 136 defining seat pivot apertures 148 and seat pivot detent 150. Seat arcuate member 136 is connected to seat support frame 130. Thus pivotal movement of seat arcuate member 136 also moves seat support frame 130.

Seat support 104 pivots relative to frame 102 about pivot axis PA. Pivotal movement of seat support 104 is provided by the coupling of pivot arrangement 108 and pivot arrangement connectors 134. Pivot arrangement 108 is secured to frame 102. Pivot arrangement connectors 134 are secured to seat support frame 130. Generally, pivot axis PA is orthogonal, but skew, to a length of middle portion 114.

Seat support 104 is pivotably adjustable in a range of motion relative to frame 102. Seat pivot detent 150, in combination with the plurality of seat pivot apertures 148 defined by seat arcuate member 136, enables selectable pivoting and positioning of seat support 104. Seat pivot detent 150 is sized to pass through frame 102 and one of seat pivot apertures 148 to position seat support 104 as required or desired. To adjust the degree of pivoting, a user pulls seat pivot detent 150 away from frame 102, adjusts the angle of seat support 104, and then aligns one of the seat pivot apertures 148 with seat pivot detent 150. In some instances, seat pivot detent 150 is connected to frame 102, for example, by a spring. Alternatively, seat pivot detent 150 is removable from frame 102.

A degree of pivoting of seat support 104 is shown as angle $\alpha$ relative to horizontal H. Pivoting above H is a positive value of a and pivoting below H is a negative value of a. In examples, the pivotal range of motion of seat support 104 is at least 0° (that is, horizontal) and not greater than about 90° (vertical). In some examples, the pivotal range of motion of seat support 104 is not greater than about 75°. Relative to the horizontal H, seat support 104 is capable of pivoting from 0° to about −25° or greater.

Seat support 104 is also slidably adjustable along seat support frame 130. Seat support frame 130 defines a plurality of position apertures 142. Slide detent 146 is sized to pass through position apertures 142. The distance of seat pad 132 from pivot arrangement 108 is adjusted by a user pulling slide detent 146 away from seat support frame 130, adjusting the slide distance of seat pad 132, and then aligning slide detent 146 with one of the position apertures 142.

Broadly, back support 106 provides a surface to support a user's torso in a sitting or lying down position. Back support 106 is a relatively larger component of adjustable bench assembly 100 than seat support 104. Back support 106 includes back support frame 152, pivot arrangement link 154, back arcuate assembly 156, and back support pad 158. Back support frame 152 is the structure to which pivot arrangement link 154 and back arcuate assembly 156 connect.

Back support 106 also pivots relative to frame 102 about pivot axis PA, described above. Pivotal movement of back support 106 is provided by the coupling of pivot arrangement 108 and pivot arrangement link 154.

Back arcuate assembly 156 includes back arcuate member 160 connected to back support frame 152 and back pivot detent 162. Back arcuate member 160 defines a plurality of apertures 164. As shown, apertures 164 are not equally-spaced from each other. However, in some instances, apertures 164 are equally spaced along back arcuate member 160. Back support pad 158 provides a cushioned surface for a user and may be connected to back support frame 152 with one or more brackets, fasteners, or other elements.

Back pivot detent 162, in combination with the plurality of back pivot apertures 164 defined by back arcuate member 160, enables selectable pivoting of back support 106. Back pivot detent 162 is sized to pass through frame 102 and one of the back pivot apertures 164. To adjust the degree of pivoting, a user pulls back pivot detent 162 away from frame 102, adjusts the angle of back support 106, and then aligns one of the back pivot apertures 164 with back pivot detent 162. In some instances, back pivot detent 162 is connected to frame 102, for example, by a spring. Alternatively, back pivot detent 162 is removable from frame 102.

Back support 106 is pivotably adjustable in a range of motion relative to frame 102. Pivotal motion of back support 106 is independent of pivotal motion of seat support 104. A degree of pivoting of back support 106 is shown as angle θ relative to horizontal H. In examples, the pivotal range of back support is at least 0° (that is, horizontal) and not greater than about 90° (vertical). In some examples, the pivotal range of motion of back support 106 is not greater than about 80°. Relative to the horizontal, back support 106 is capable of being positioned from about 0° to 90°. In another example, the back support 106 is capable of being positioned from about 0° to 85°.

Adjustable bench assembly 100 can be positioned on a variety of surfaces and frame 102 includes feet 120 that limit or prevent unintentional movement of adjustable bench assembly 100. In some examples, adjustable bench assembly 100 includes lift bar 170 and roller assembly 172. A user can grab lift bar 170, thereby tilting adjustable bench assembly 100 upwards such that roller assembly 172 engages the ground to be repositioned.

Figure 6:
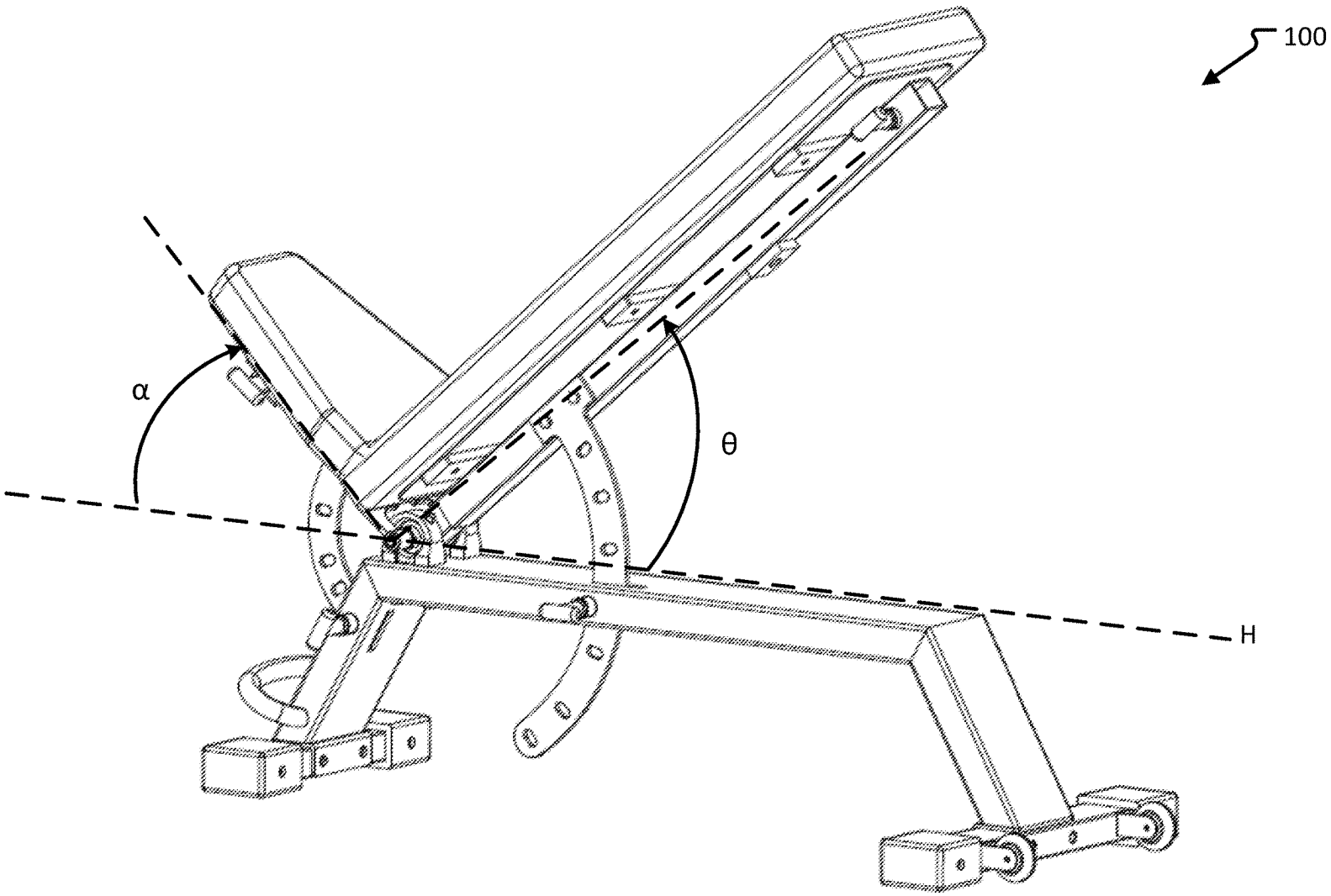
FIG. 6 is a rear perspective view of the adjustable bench assembly of FIG. 1.

FIG. 6 shows adjustable bench assembly 100 in a reclined, seated orientation. Seat support 104 is pivoted to its maximum upward position. Back support 106 is pivoted to roughly half its maximum upward position. Additionally, seat pad 132 has been slidably adjusted such that it abuts back support pad 158, thus eliminating any gap between those elements. Elimination of this gap may be desirable for user comfort, support, and other purposes.

Figure 7:
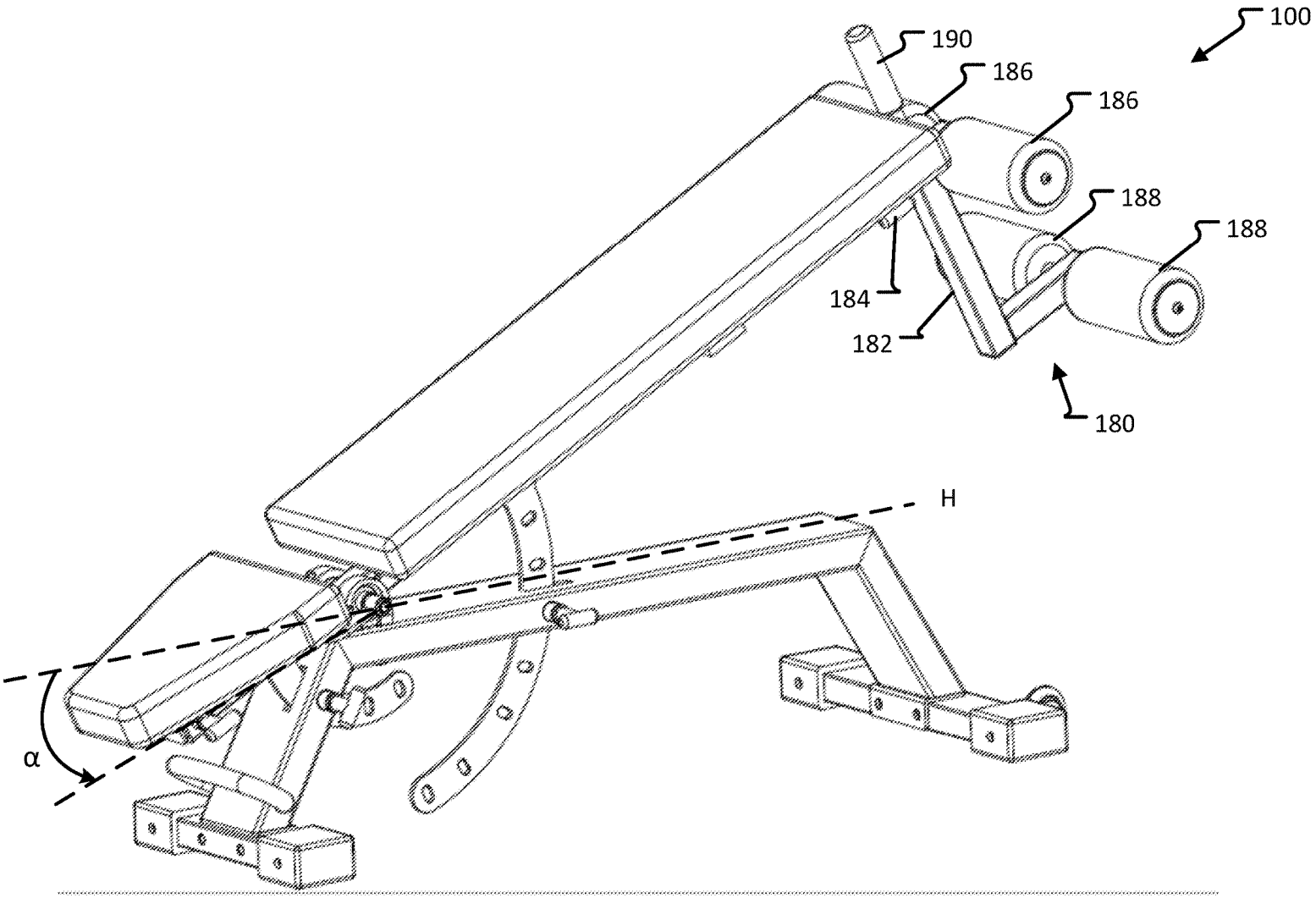
FIG. 7 is a front perspective view of the adjustable bench assembly of FIG. 1 additionally including a leg support arrangement.

FIG. 7 shows adjustable bench assembly 100, including optional leg support arrangement 180. As shown, adjustable bench assembly 100 is positioned in a reclined position. Leg support arrangement 180 is removably coupled to back support frame 152 such that as back support 106 pivots, so too does the leg support arrangement 180. Leg support arrangement 180 includes leg support frame 182, leg support detent 184, upper leg braces 186, lower leg braces 188, and grip bar 190. Optionally, lower leg braces 188 are adjustable such that the distance of lower leg braces 188 relative to the back support pad 158 may be adjusted.

Generally, a user uses leg support arrangement 180 to restrain the legs, especially during exercises that involve inversion of the user. In the configuration of adjustable bench assembly 100 shown in FIG. 7, leg support arrangement 180 enables a user to perform exercises in a stable position, even though gravity would otherwise cause the user to slide towards the ground. Typically, a user's head would rest on or near seat support 104 when using adjustable bench assembly 100 configured as shown in FIG. 7.

FIGS. 8A-8D are side plan views of adjustable bench assembly 200 in various positions. Generally, FIGS. 8A-8D demonstrate independent sliding and pivoting capability of adjustable bench assembly 200. Adjustable bench assembly 200 includes some or all components of adjustable bench assembly 100, discussed above. Adjustable bench assembly 200 includes frame 201, pivot assembly 202, seat pad 204, slide assembly 206, seat arcuate member 208, back pad 210, and back arcuate member 212.

Figure 8A:
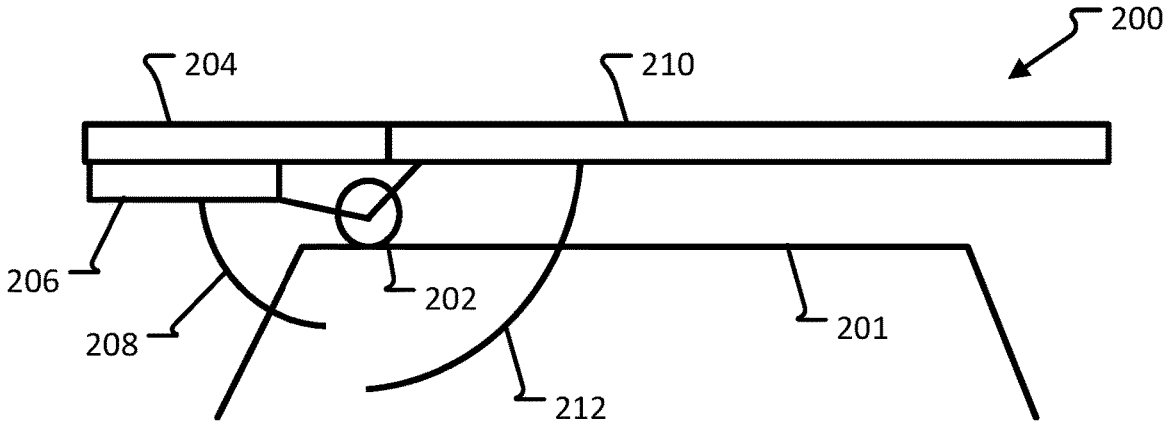
FIGS. 8A-8D are schematic diagrams of an example adjustable bench assembly in various positions.
Figure 8B:
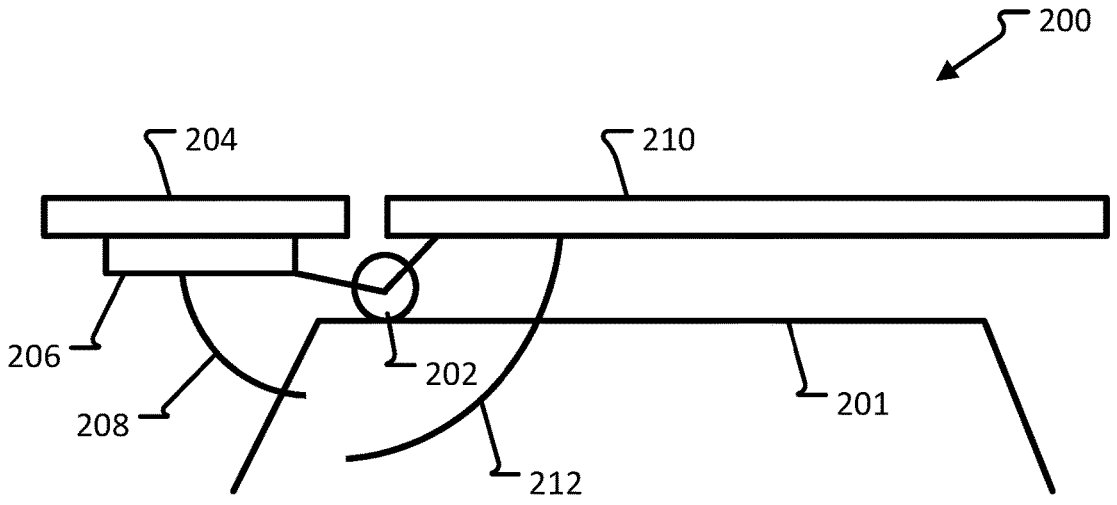

FIG. 8A shows adjustable bench assembly 200 oriented such that seat pad 204 and back pad 210 are in a lie-flat position. Seat pad 204 abuts back pad 210 in this configuration, thus eliminating or reducing gaps therebetween, for support, comfort, etc. In order to transition adjustable bench assembly 200 from the lie-flat position to a seated position, seat pad 204 is slidably adjusted away from back pad 210. A position of seat pad 204 spaced from back pad 210 is shown in FIG. 8B. Generally, regardless of the relative pivoting of seat pad 204 and back pad 210, space can exist between the two, as shown in FIG. 8A, or the two may abut, as shown in FIG. 8B.

Figure 8C:
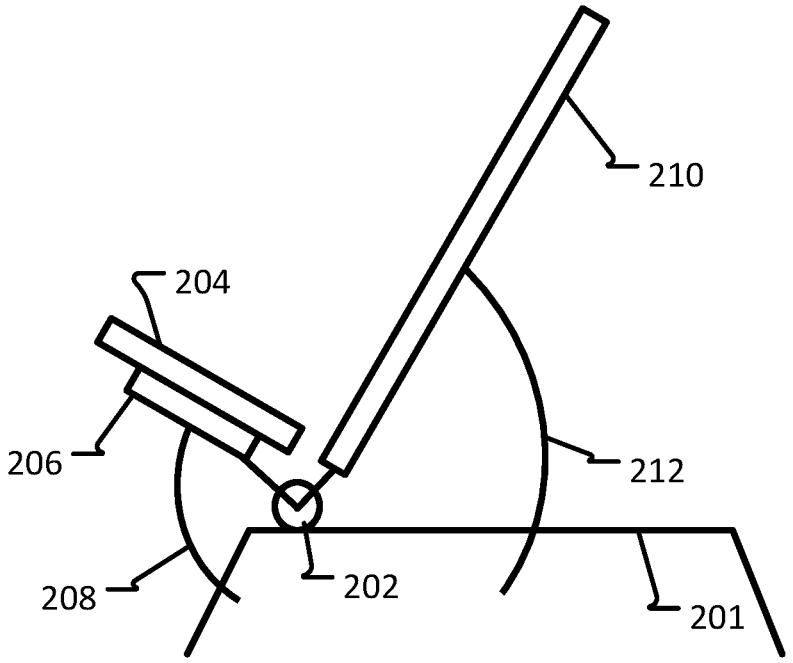
Figure 8D:
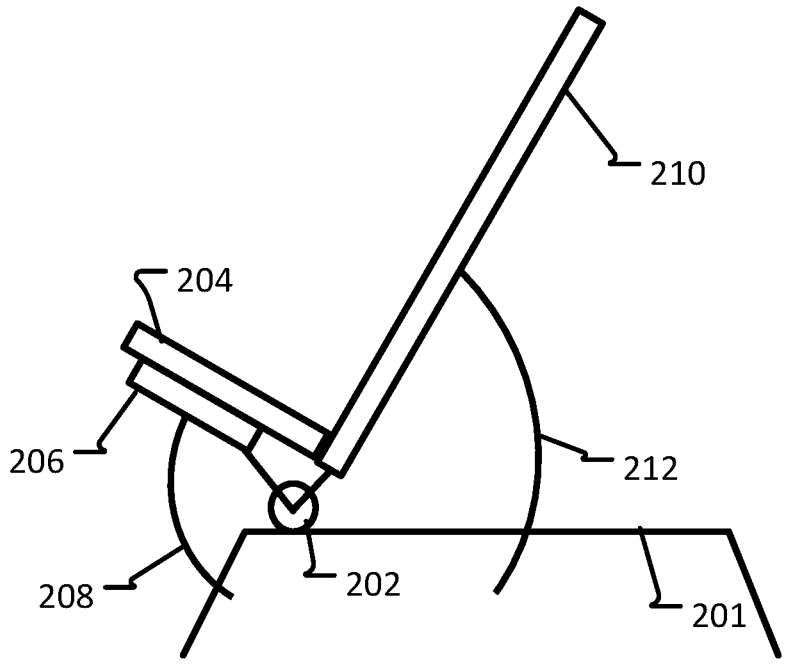

After positioning seat pad 204 away from back pad 210, seat pad 204 is pivoted upward (relative to the horizontal) and, separately, back pad 210 is pivoted upward (relative to the horizontal). This configuration is shown in FIG. 8C. Similar to FIG. 8B, there is space between seat pad 204 and back pad 210. After pivoting seat pad 204 and back pad 210, seat pad 204 is slidably adjusted such that it abuts back pad 210, as shown in FIG. 8D.

FIGS. 9A-9D are side plan views of adjustable bench assembly 300 in various positions. Generally, FIGS. 9A-9D demonstrate independent sliding and pivoting capability of adjustable bench assembly 300. Adjustable bench assembly 300 includes some or all components of adjustable bench assembly 100, discussed above, but additionally includes a second pivot assembly.

Adjustable bench assembly 300 includes frame 301, pivot assembly 302, pivot assembly 314, seat pad 304, slide assembly 306, seat arcuate member 208, back pad 310, and back arcuate member 312. Pivot assembly 302 and pivot assembly 314 are both connected to frame 301 and adjacent each other.

Figure 9A:
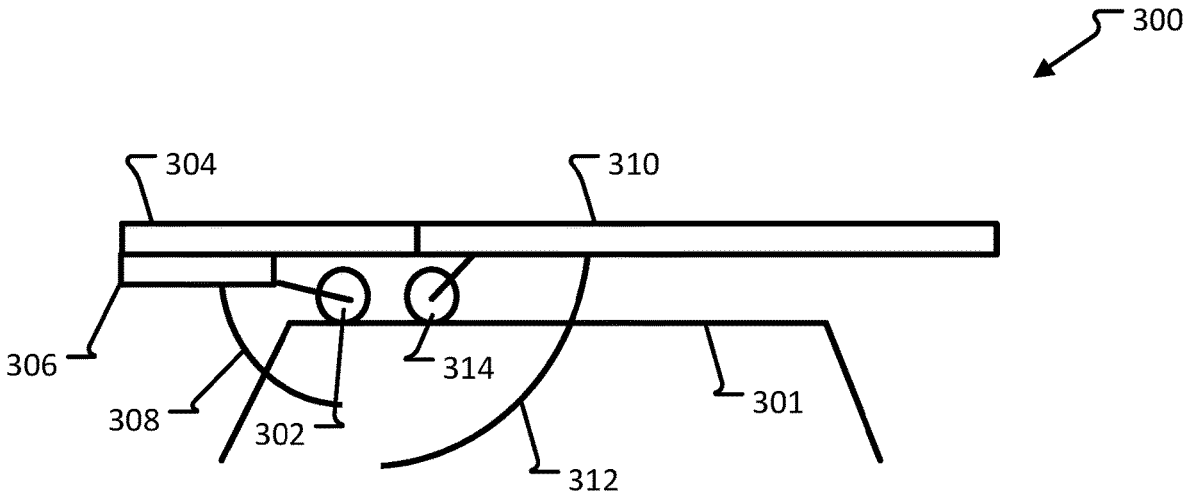
FIGS. 9A-9D are schematic diagrams of an example adjustable bench assembly in various positions.
Figure 9B:
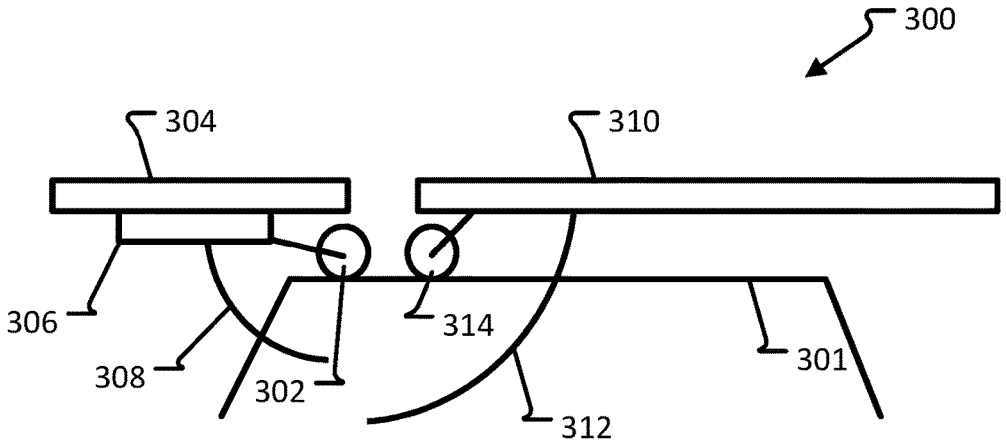

FIG. 9A shows adjustable bench assembly 300 oriented such that seat pad 304 and back pad 310 are in a lie flat position. Seat pad 304 abuts back pad 310 in this configuration. In order to transition adjustable bench assembly 300 from the lie flat position to a seated position, seat pad 304 is slidably adjusted away from back pad 310. A position of seat pad 304 spaced from back pad 310 is shown in FIG. 9B. Generally, regardless of the relative pivoting of seat pad 304 and back pad 310, space can exist between the two, as shown in FIG. 9A, or the two may abut, as shown in FIG. 9B.

Figure 9C:
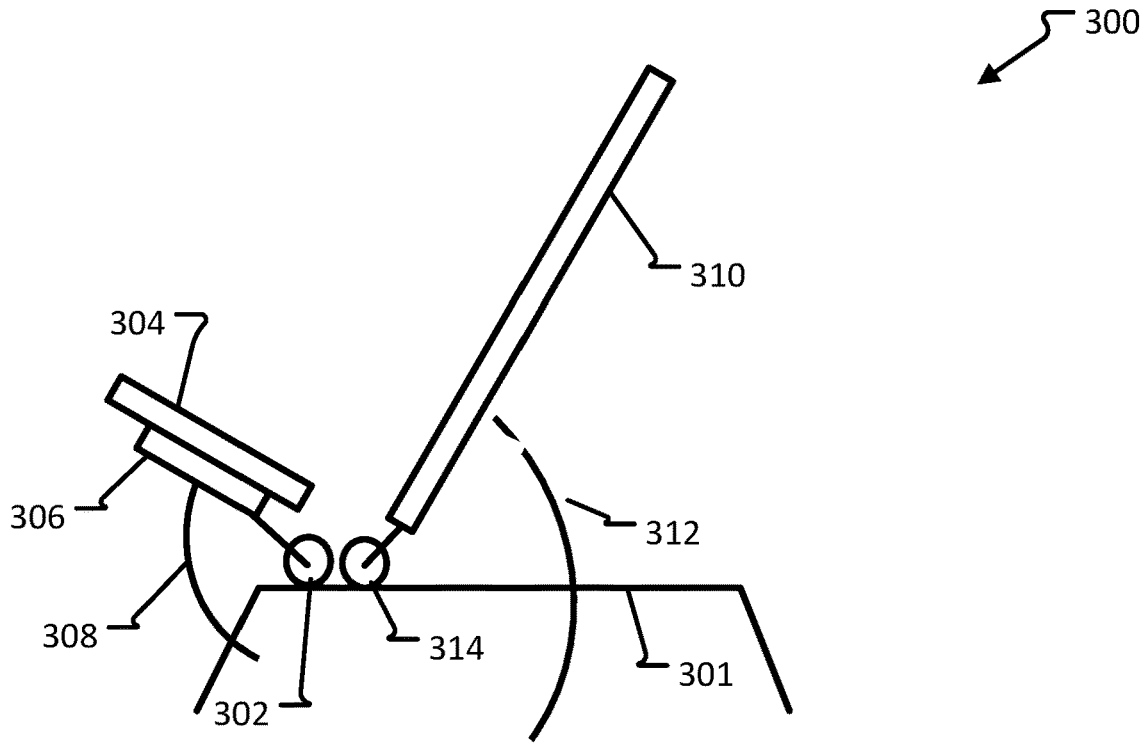
Figure 9D:
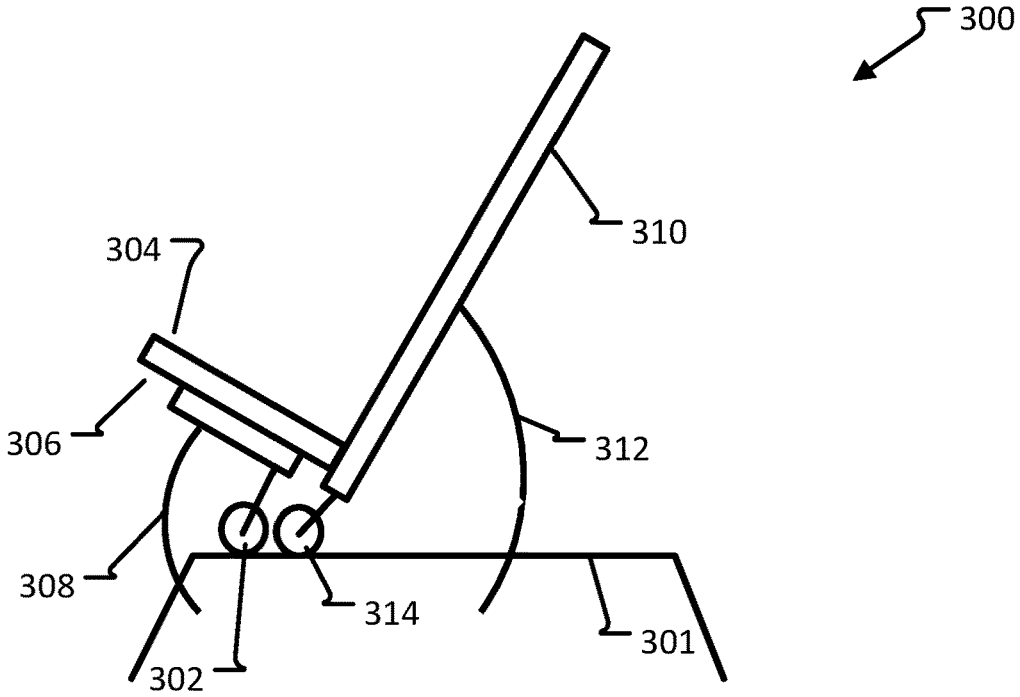
Figure 10:
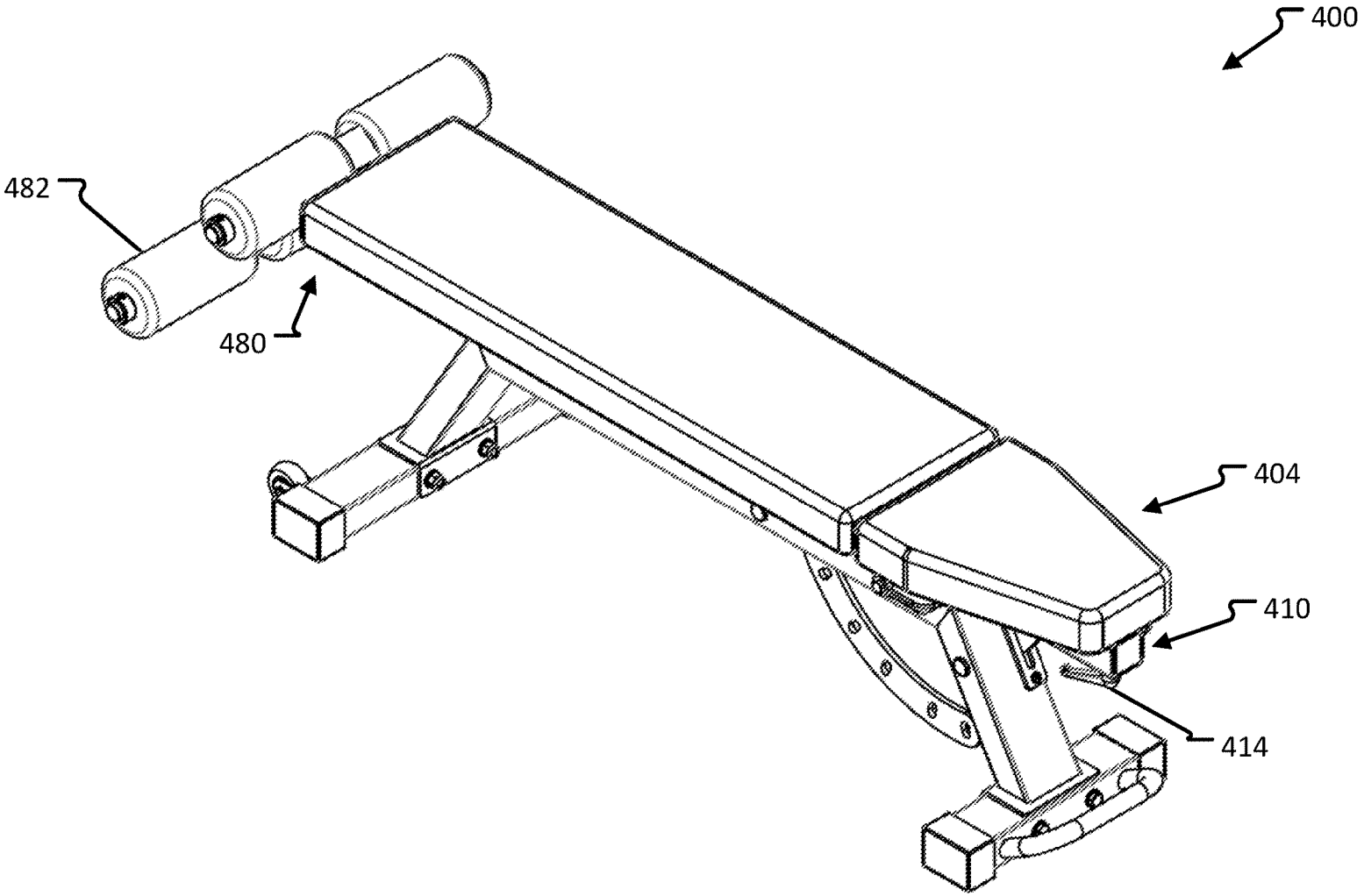
FIG. 10 is a front top perspective view of an example adjustable bench assembly.
Figure 11:
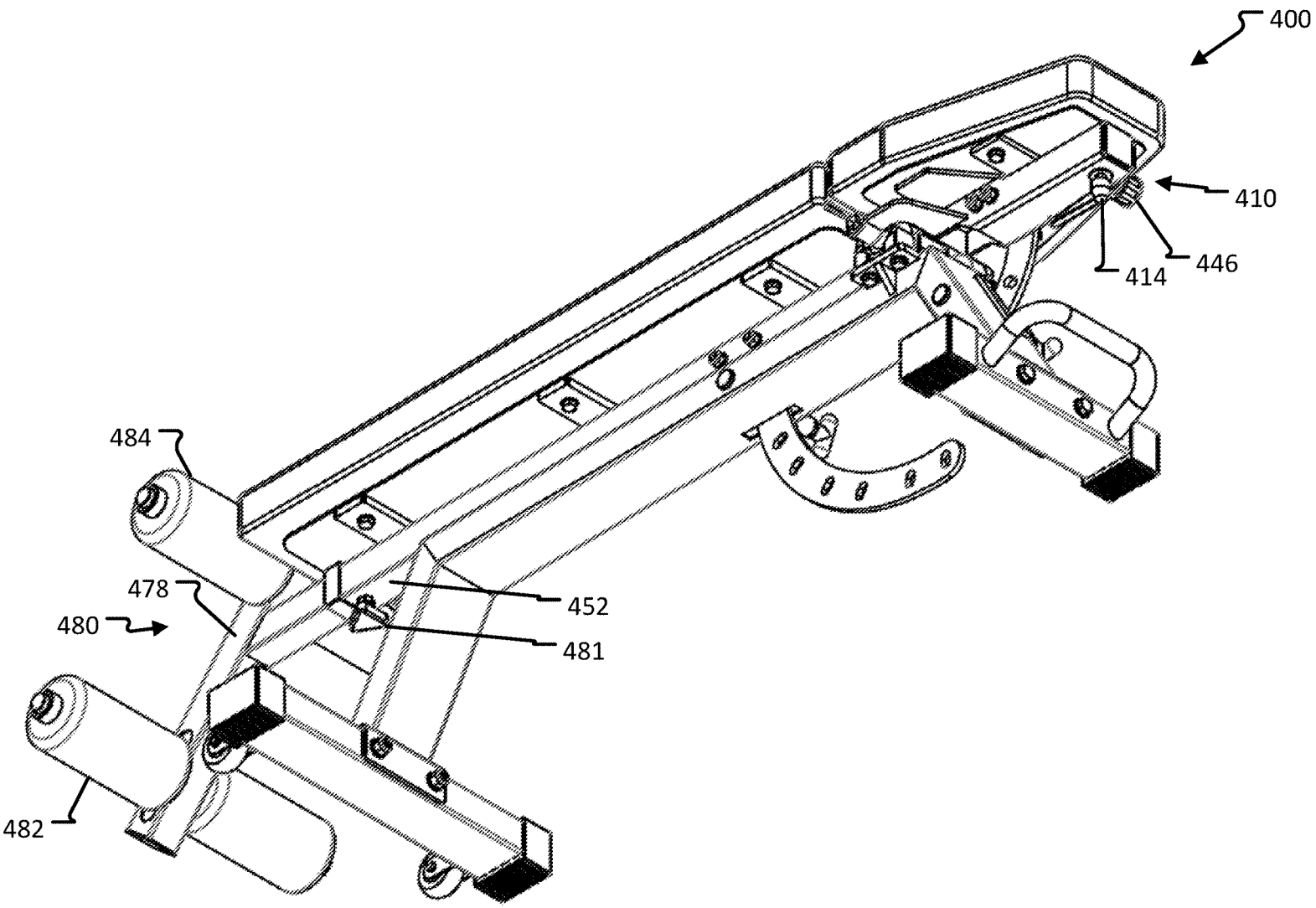
FIG. 11 is a bottom perspective view of the adjustable bench assembly of FIG. 10.

After positioning seat pad 304 away from back pad 310, seat pad 304 is pivoted upward (relative to the horizontal) and, separately, back pad 310 is pivoted upward (relative to the horizontal. This configuration is shown in FIG. 9C. Similar to FIG. 9B, there is space between seat pad 304 and back pad 310. After pivoting seat pad 304 and back pad 310, seat pad 304 is slidably adjusted such that it abuts back pad 310, as shown in FIG. 9D.

FIGS. 10-13 depict various views of example adjustable bench assembly 400 and its components and are described concurrently below. Many components of adjustable bench assembly 400 are the same or similar to adjustable bench assembly 100, shown and described with reference to FIGS. 1-6 above. Notable differences in adjustable bench assembly 400 include a secondary securing assembly 410 and leg support arrangement 480.

Figure 12B:
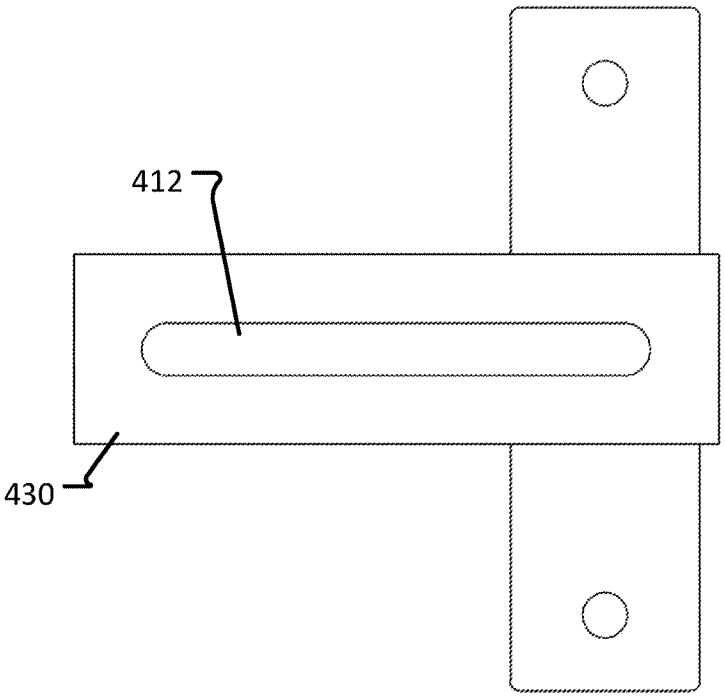
FIG. 12B is a bottom plan view of the seat support frame of FIG. 12A.
Figure 12A:
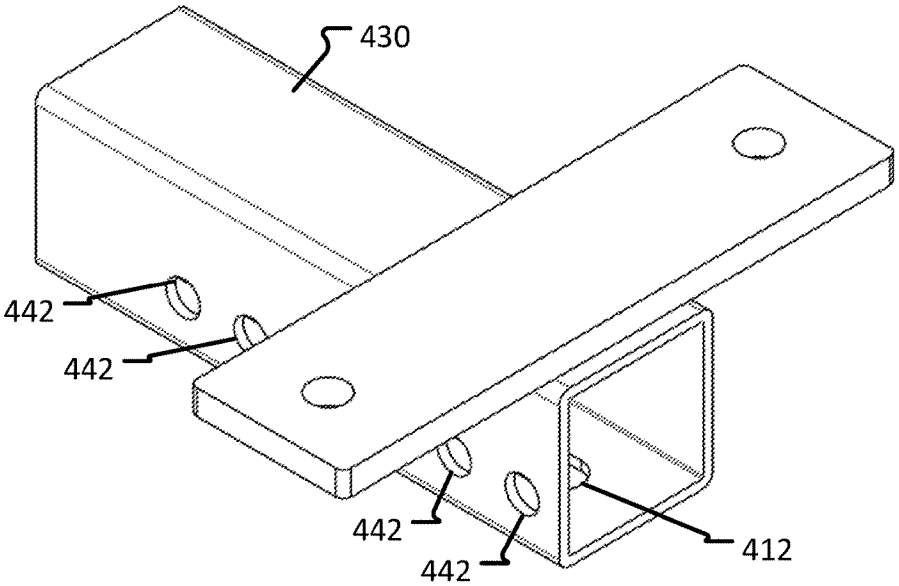
FIG. 12A is a perspective view of a seat support frame of the adjustable bench assembly of FIG. 10.
Figure 13:
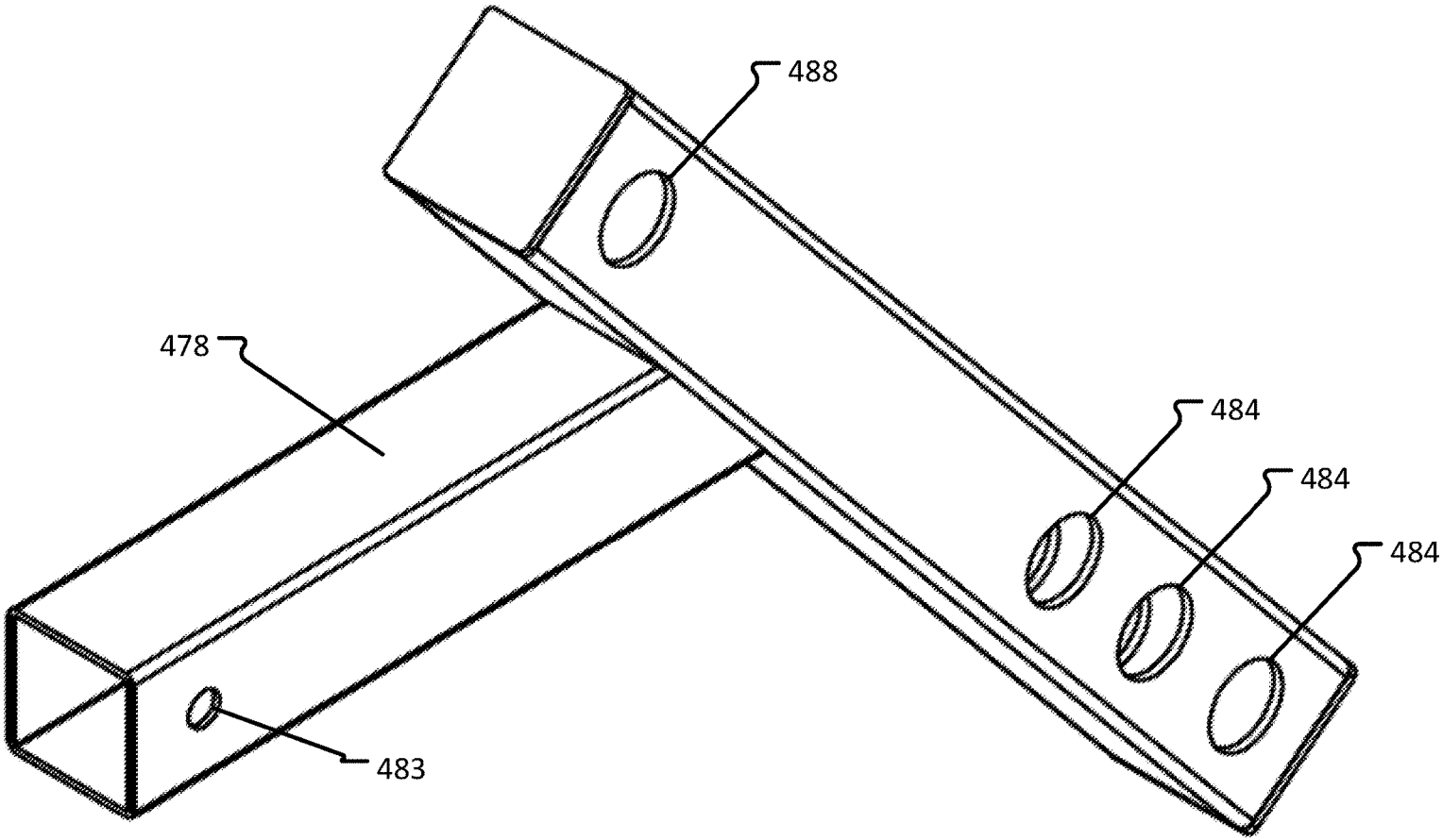
FIG. 13 is a perspective view of a leg support frame of the adjustable bench assembly of FIG. 10.

As shown most clearly in FIGS. 12A and 12B, seat support frame 430 defines both position apertures 442 and secondary securing channel 412. Slide detent 446 engages and disengages with position apertures 442 to provide a plurality of positions of seat support 404.

Secondary securing assembly 410 includes seat support frame 430 that defines secondary securing channel 412 and locking element 414. When in a disengaged configuration, locking element 414 slides along secondary securing channel 412. Then, when slide detent 446 is positioned, locking element 414 locks to seat support frame 430 through means known to those in the art.

Leg support arrangement 480 includes leg support frame 478, lower leg brace 482 and upper leg brace 486. Leg support arrangement 480 secures to back support frame 452 via turn knob 481 passing through securing aperture 483.

The relative position of the lower leg brace 482 along angled portion of leg support arrangement 480 can be adjusted via position apertures 484. In this way, varying leg and/or shin lengths of different users can be accommodated. Upper leg brace 486 is not position-adjustable like lower leg brace 482 and connects via aperture 488.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified examples and examples. In this regard, any number of the features of the different examples described herein may be combined into one single example and alternate examples having fewer than or more than all of the features herein described are possible.

While various examples have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed is:

1. An adjustable bench comprising:

a bench frame;

a seat support frame pivotably coupled to the bench frame at a pivot, wherein the pivot is configured for pivotal movement of the seat support frame about a first axis;

a first arcuate assembly in communication with the bench frame and the seat support frame, the first arcuate assembly including a first arcuate member and a first detent;

a seat pad mounting bracket slidably positionable along the seat support frame relative to the pivot; and a back support pivotably coupled to the bench frame at the pivot, wherein the pivot is configured for pivotal movement of the back support about the first axis.

2. The adjustable bench according to claim 1, wherein the pivot further connects the bench frame to the back support.

3. The adjustable bench according to claim 2, further comprising a first pad connected to the seat pad mounting bracket.

4. The adjustable bench according to claim 3, further comprising a second pad connected to the back support.

5. The adjustable bench according to claim 1, further comprising a second arcuate assembly in communication with the bench frame and the back support, the second arcuate assembly including a second arcuate member and a second detent.

6. The adjustable bench according to claim 5, wherein the first arcuate assembly comprises a seat range of motion of at least 15 degrees and no greater than 120 degrees.

7. The adjustable bench according to claim 5, wherein the second arcuate assembly comprises a back range of motion of at least 15 degrees and no greater than 95 degrees.

8. The adjustable bench according to claim 5, the back support further comprising a leg support arrangement.

9. The adjustable bench according to claim 8, wherein the leg support arrangement is slidably coupled to the back support.

10. The adjustable bench according to claim 9, the leg support arrangement further comprising a grip member.

11. The adjustable bench according to claim 5, the bench frame further comprising:

a lift bar positioned near a first end of the bench frame; and a roller assembly positioned near a second end of the bench frame.

12. An exercise support assembly comprising:

a frame arrangement;

a lower support pivotably connected to the frame arrangement at a pivot arrangement, the lower support including a slide assembly providing slidable adjustment of the lower support relative to the pivot arrangement, the lower support including a first pad;

an upper support pivotably connected to the frame arrangement at the pivot arrangement and independently pivotable from the lower support, the upper support including a second pad;

a first arcuate assembly in communication with the frame arrangement and the lower support, the first arcuate assembly including a first arcuate member and a first detent; and a second arcuate assembly in communication with the frame arrangement and the upper support, the second arcuate assembly including a second arcuate member and a second detent, wherein each of the slide assembly, the first arcuate assembly and the second arcuate assembly are independently adjustable.

13. The exercise support assembly according to claim 12, wherein:

the first arcuate assembly provides a lower support pivot range of at least 15 degrees and no greater than 120 degrees; and the second arcuate assembly provides an upper support pivot range of at least 15 degrees and no greater than 95 degrees.

14. The exercise support assembly according to claim 12, wherein the first arcuate member defines at least three position apertures, each of the at least three position apertures sized to receive the first detent; and wherein the second arcuate member defines at least five position apertures, each of the at least five position apertures sized to receive the second detent.

15. The exercise support assembly according to claim 12, wherein the upper support further comprises a leg arrangement, the leg arrangement slidably coupled to the upper support.

16. The exercise support assembly according to claim 15, the leg arrangement further comprising a grip member and a third detent.

17. The exercise support assembly according to claim 16, wherein the frame arrangement further includes:

a lift bar positioned near a first end of the frame arrangement; and a roller assembly positioned near a second end of the frame arrangement.

18. A method of using an adjustable bench assembly comprising a frame, a seat pad, and a back support pad, comprising:

adjusting a seat support using a slide assembly coupled to the adjustable bench assembly, wherein adjusting the seat support using the slide assembly moves the seat pad linearly relative to the back support pad and the frame;

independent of adjusting the seat support using the slide assembly, adjusting the seat support using a seat pivot adjuster coupled to the adjustable bench assembly and the seat support, wherein adjusting the seat support using the seat pivot adjuster moves the seat pad pivotably relative to the back support pad and about a pivotal axis defined by the seat pivot adjuster; and independent of adjusting the seat support using the slide assembly and independent of adjusting the seat support using the seat pivot adjuster, adjusting a back support using a back pivot adjuster coupled to the adjustable bench assembly and the back support, wherein adjusting the back support using the back pivot adjuster moves the back support pad pivotably relative to the seat pad and about the pivotal axis.

* * * * *